US007798223B2

(12) United States Patent
Duggan et al.

(10) Patent No.: US 7,798,223 B2
(45) Date of Patent: Sep. 21, 2010

(54) BORE ISOLATION

(75) Inventors: Andrew Michael Duggan, Aberden (GB); Gareth Lyle Innes, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/426,795

(22) Filed: Jun. 27, 2006

(65) Prior Publication Data

US 2006/0283607 A1 Dec. 21, 2006

Related U.S. Application Data

(63) Continuation of application No. 10/328,500, filed on Dec. 24, 2002, now Pat. No. 7,066,259.

(30) Foreign Application Priority Data

Dec. 27, 2001 (GB) ..... 0131019.2

(51) Int. Cl.
*E21B 43/10* (2006.01)

(52) U.S. Cl. ..... 166/277; 166/195; 166/207; 166/212

(58) Field of Classification Search ..... 166/277, 166/381, 384, 179, 195, 196, 118, 206, 207, 166/212, 214, 216, 217, 242.1, 242.2
See application file for complete search history.

(56) References Cited

U.S. PATENT DOCUMENTS

| | | | | |
|---|---|---|---|---|
| 2,214,226 | A | | 9/1940 | English |
| 2,812,025 | A | | 11/1957 | Teague et al. |
| 2,945,541 | A | | 7/1960 | Maly et al. |
| 3,191,677 | A | | 6/1965 | Kinley |
| 3,385,367 | A | | 5/1968 | Kollsman |
| 3,477,506 | A | * | 11/1969 | Malone ..... 166/207 |
| 3,509,016 | A | | 4/1970 | Underwood et al. |
| 3,785,193 | A | | 1/1974 | Kinley et al. |
| 3,918,523 | A | | 11/1975 | Stuber |
| 4,137,970 | A | | 2/1979 | Laflin et al. |
| 4,919,989 | A | | 4/1990 | Colangelo |
| 4,936,386 | A | | 6/1990 | Colangelo |
| 4,976,322 | A | | 12/1990 | Abdrakhmanov et al. |
| 5,048,605 | A | | 9/1991 | Toon et al. |
| 5,083,608 | A | | 1/1992 | Abdrakhmanov et al. |
| 5,190,109 | A | | 3/1993 | Pardo |
| 5,195,583 | A | | 3/1993 | Toon et al. |
| 5,348,095 | A | | 9/1994 | Worrall et al. |
| 5,366,012 | A | | 11/1994 | Lohbeck |
| 5,423,630 | A | * | 6/1995 | Imoto et al. ..... 405/184.2 |
| 5,494,106 | A | | 2/1996 | Gueguen et al. |

(Continued)

FOREIGN PATENT DOCUMENTS

| | | |
|---|---|---|
| GB | 925292 | 4/1960 |

(Continued)

*Primary Examiner*—Daniel P Stephenson
(74) *Attorney, Agent, or Firm*—Patterson & Sheridan, LLP

(57) ABSTRACT

A method of isolating a section of a drilled bore containing a problem zone comprises: providing a section of tubing; locating the tubing in the section of the bore; and expanding the tubing and forming at least an outer portion of the tubing to conform to irregularities in the bore wall, to isolate the problem zone. The tubing may feature a formable outer section, and the expansion of the tubing may be achieved using a compliant rotary expander.

28 Claims, 2 Drawing Sheets

U.S. PATENT DOCUMENTS

| | | | | |
|---|---|---|---|---|
| 5,611,400 | A | 3/1997 | James et al. | |
| 5,657,822 | A | 8/1997 | James et al. | |
| 5,810,085 | A | 9/1998 | James et al. | |
| 6,070,671 | A | 6/2000 | Cumming et al. | |
| 6,098,717 | A | 8/2000 | Bailey et al. | |
| 6,253,850 | B1 | 7/2001 | Nazzai et al. | |
| 6,267,181 | B1 * | 7/2001 | Rhein-Knudsen et al. | 166/332.4 |
| 6,358,580 | B1 | 3/2002 | Mang et al. | |
| 6,371,203 | B2 | 4/2002 | Frank et al. | |
| 6,425,444 | B1 | 7/2002 | Metcalfe et al. | |
| 6,431,282 | B1 | 8/2002 | Bosma et al. | |
| 6,446,323 | B1 | 9/2002 | Metcalfe et al. | |
| 6,446,724 | B2 | 9/2002 | Baugh et al. | |
| 6,457,532 | B1 | 10/2002 | Simpson | |
| 6,543,552 | B1 | 4/2003 | Metcalfe et al. | |
| 6,585,053 | B2 | 7/2003 | Coon | |
| 6,648,075 | B2 | 11/2003 | Badrak et al. | |
| 6,688,395 | B2 | 2/2004 | Maguire et al. | |
| 6,688,397 | B2 * | 2/2004 | McClurkin et al. | 166/380 |
| 6,688,399 | B2 | 2/2004 | Maguire et al. | |
| 6,688,400 | B2 | 2/2004 | Metcalfe et al. | |
| 6,698,517 | B2 | 3/2004 | Simpson et al. | |
| 6,702,030 | B2 | 3/2004 | Simpson | |
| 6,722,441 | B2 | 4/2004 | Lauritzen et al. | |
| 6,742,606 | B2 | 6/2004 | Metcalfe et al. | |
| 6,752,215 | B2 | 6/2004 | Maguire et al. | |
| 6,752,216 | B2 | 6/2004 | Coon | |
| 6,834,725 | B2 | 12/2004 | Whanger et al. | |
| 6,840,325 | B2 | 1/2005 | Stephenson | |
| 2002/0079100 | A1 | 6/2002 | Simpson et al. | |
| 2002/0139540 | A1 | 10/2002 | Lauritzen | |
| 2002/0166668 | A1 | 11/2002 | Metcalfe et al. | |
| 2002/0195256 | A1 | 12/2002 | Metcalfe et al. | |
| 2003/0047320 | A1 | 3/2003 | Badrak et al. | |
| 2003/0047323 | A1 | 3/2003 | Jackson et al. | |
| 2003/0075337 | A1 | 4/2003 | Maguire | |
| 2003/0085041 | A1 | 5/2003 | Maguire et al. | |
| 2003/0106697 | A1 | 6/2003 | Bode et al. | |
| 2003/0132032 | A1 | 7/2003 | Metcalfe et al. | |
| 2003/0136561 | A1 | 7/2003 | Metcalfe et al. | |
| 2003/0192717 | A1 * | 10/2003 | Smith et al. | 175/61 |
| 2003/0205386 | A1 | 11/2003 | Johnston et al. | |
| 2004/0007364 | A1 | 1/2004 | Simpson | |
| 2004/0044758 | A1 | 3/2004 | Palmer et al. | |
| 2004/0055786 | A1 | 3/2004 | Maguire et al. | |
| 2004/0065446 | A1 | 4/2004 | Tran et al. | |
| 2004/0112609 | A1 | 6/2004 | Whanger et al. | |
| 2004/0118572 | A1 | 6/2004 | Whanger et al. | |
| 2004/0231861 | A1 | 11/2004 | Whanger et al. | |
| 2005/0173109 | A1 * | 8/2005 | Cameron | 166/206 |

FOREIGN PATENT DOCUMENTS

| | | |
|---|---|---|
| GB | 2 230 271 | 6/1998 |
| GB | 2 346 400 | 8/2000 |
| GB | 2 347 445 | 9/2000 |
| JP | 4363499 | 12/1992 |
| JP | 9151686 | 6/1997 |
| JP | 2000064764 | 2/2000 |
| WO | WO 93/18274 | 9/1993 |
| WO | WO 99/02818 | 1/1999 |
| WO | WO 99/35638 | 7/1999 |
| WO | WO 00/37766 | 6/2000 |
| WO | WO 00/50732 | 8/2000 |
| WO | WO 01/33037 | 5/2001 |
| WO | WO 02/25056 | 3/2002 |
| WO | WO 02059452 A1 * | 8/2002 |

* cited by examiner

BORE ISOLATION

CROSS-REFERENCE TO RELATED APPLICATIONS

This application is a continuation of co-pending U.S. patent application Ser. No. 10/328,500, filed Dec. 24, 2002, now U.S. Pat. No. 7,066,259, which claims priority to GB 0131019.2, filed on Dec. 27, 2001. Each of the aforementioned related patent applications is herein incorporated by reference.

BACKGROUND OF THE INVENTION

1. Field of the Invention

This invention relates to bore isolation, and in particular to methods and apparatus for use in isolating a section of a drilled bore, or sealing the wall of a section of a drilled bore.

2. Description of the Related Art

In the oil and gas exploration and production industry, wells are created by drilling bores from surface to access subsurface hydrocarbon reservoirs. A drill bit is mounted on the end of a string of drill pipe which extends from the surface. The string and bit may be rotated from surface, or the bit may be rotated by a downhole motor. Drilling fluid or "mud" is pumped through the drill string from the surface, to exit the string at the bit. The fluid carries the cuttings produced by the drill bit to surface, through the annulus between the drill string and the bore wall.

The drilled "open" bore is lined with metallic tubing, known as casing or liner, which is secured and sealed in the bore by injecting a cement slurry into the annulus between the liner and the bore wall.

Often, a drilling operation will encounter a "loss zone", typically a void or an area of porous or fractured strata or a formation in which the in situ pressure regime is lower than in the other exposed zones. When drilling through a loss zone, large volumes of drilling fluid may be lost, at great expense and inconvenience. The loss of drilling fluid may also result in a significant differential fluid pressure between the drill string and the annulus, during drilling and indeed any other downhole operation, which has significant implications for operational safety and operation of conventional downhole tools and devices.

Furthermore, some production zones, such as fractured carbonate reservoirs, act as loss zones. Thus, following completion of a bore, and before oil is produced, much of the drilling fluid lost into the reservoir during drilling must be removed, by "back-producing", which is both time consuming and expensive.

A further difficulty when a drilled bore crosses a loss zone is that it is difficult to place and successfully cement a conventional bore liner across the zone; the loss zone prevents the cement from being placed across the liner.

As noted above, fractured carbonate reservoirs which are one of the producing formations for oil can act as multiple loss zones. However, to obtain increased production rates, it is desirable that a well accesses a large area of reservoir and thus may intersect many loss zones. Thus, if the first fracture encountered cannot be isolated, by lining and cementing, due to losses, the well cannot be drilled further, and the well can only be produced from this first fracture, limiting production.

A different but related problem is encountered when a drilled bore intersects a relatively high pressure, or "over pressured" zone, which may result in undesirable and possibly uncontrolled flow of fluid into a bore. This flow of fluid into the bore disrupts the normal circulation of drilling fluid, and may have well control implications as the density of the fluid column changes. Furthermore, the reliance on increasing the drilling fluid pressure to retain fluid in the over pressured zone by, for example, using relatively dense drilling fluid, limits the ability to drill the bore beyond the over pressured zone, since fluid losses may occur into other exposed zones which are naturally of a normal or sub-normal pressure regime.

It is among the objectives of embodiments of the present invention to obviate or mitigate these difficulties.

SUMMARY OF THE INVENTION

According to a first aspect of the present invention, there is provided a method of isolating a section of a drilled bore, the method comprising the steps of:

providing a section of tubing;

locating the tubing in a section of a bore; and expanding the tubing by moulding at least an outer portion of the tubing to conform to irregularities in the bore wall, to isolate at least a portion of the bore wall.

A second aspect of the invention relates to apparatus for use in implementing the method.

The invention has particular application in isolating problem zones, such as loss zones, over pressured zones, water-producing zones, or a section of bore where a mechanical collapse has occurred or is considered likely to occur, and thus the section of tubing will typically be located in a section of bore across such a problem zone.

Preferably, the tubing wall comprises a structural layer and an outer relatively formable layer for contact with the bore wall; the outer layer may be deformed on contact with the bore wall to provide a contact area which follows the irregularities of the bore wall, and preferably to provide a hydraulic seal between the tubing and the bore wall. Typically, the structural layer will be metallic, such as a steel or other alloy, but may be of any appropriate material. Typically, the formable layer will be of an elastomer, but may also be a relatively soft metal or other malleable material. In certain embodiments, the outer layer may be formed of a material which swells or expands in situ. Such swelling or expansion may be temperature dependent, and take advantage of the elevated temperatures normally experienced downhole, or may be in response to the presence of a reactant or catalyst, or an energy input. In one embodiment, a swelling elastomer may be utilised, which swells through contact with hydrocarbon fluids.

Preferably, the tubing is expanded beyond its yield point, such that the expansion of the tubing is retained by the tubing itself. In other embodiments, the tubing may not reach yield during expansion and may be provided with some other means or mechanism for retaining the desired expanded form.

Preferably, the tubing is located in a bore below an existing section of bore-lining tubing. An upper end of the expanded tubing overlaps the existing tubing, and is most preferably sealed thereto. However, in other embodiments the tubing may be located solely within an open portion of the bore, and does not overlap with any existing tubing.

Preferably, the method further comprises drilling below an existing section of bore-lining tubing to a larger diameter than the inner diameter of the existing tubing. This may be achieved by, for example, use of an expandable or bicentred bit, or by means of an underreamer. This allows tubing placed below the existing tubing to be expanded to a diameter similar to or larger than that of the existing tubing, such that there is no significant loss in bore diameter.

Preferably, the method further comprises drilling a lower portion of the section of bore to a larger diameter than an upper section of the bore, and expanding a lower portion of the tubing to a larger expanded diameter than an upper section of the tubing. This larger diameter portion may then be utilised to accommodate the upper end of a further tubing section, such that a further tubing section may be installed without loss of hole size.

Preferably, the tubing is expanded using a variable diameter expansion device, that is a device which is capable of expanding the tubing to a variety of different diameters, and thus accommodate irregularities in the bore wall and maintain the expanded tubing in contact with a large area of the tubing wall. Most preferably, a compliant rotary or rolling expander is utilized, that is an expander which comprises at least one expansion member, and typically a plurality of expansion members, which operate independently and are biased radially outwardly to engage and expand the tubing as the expander is rotated or otherwise translated through the tubing. Such an expander is described in U.S. Pat. No. 6,457,532, which corresponds to our earlier application WO00/37766, the disclosure of which is incorporated herein by reference. Alternatively, an axially translatable compliant expander may be utilized, such as sold by the applicant under the ACE trade mark, and examples of which are described in U.S. Patent Publication 20030127774, which claims priority to our application GB 0128667.3, the disclosure of which is incorporated herein by reference. The use of such expanders in open hole applications offers numerous advantages over conventional cone or swage expansion devices, with which it is not possible to obtain full circumferential contact with the surrounding bore wall, and thus not possible to achieve sealing contact with the bore wall.

In other embodiments, a fixed diameter expansion device, such as a cone or mandrel, may be utilised to expand the tubing, in such a case the moulding of the outer surface of the tubing to the bore wall may be achieved by provision of a formable outer portion on the tubing, or an outer portion which swells or otherwise expands in situ.

In certain embodiments two or more expansion devices may be provided, and the expansion devices may differ, for example a fixed diameter expansion device may be utilised in combination with a compliant expansion device.

In other embodiments, cement may be injected into the annulus between the tubing and the bore wall.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
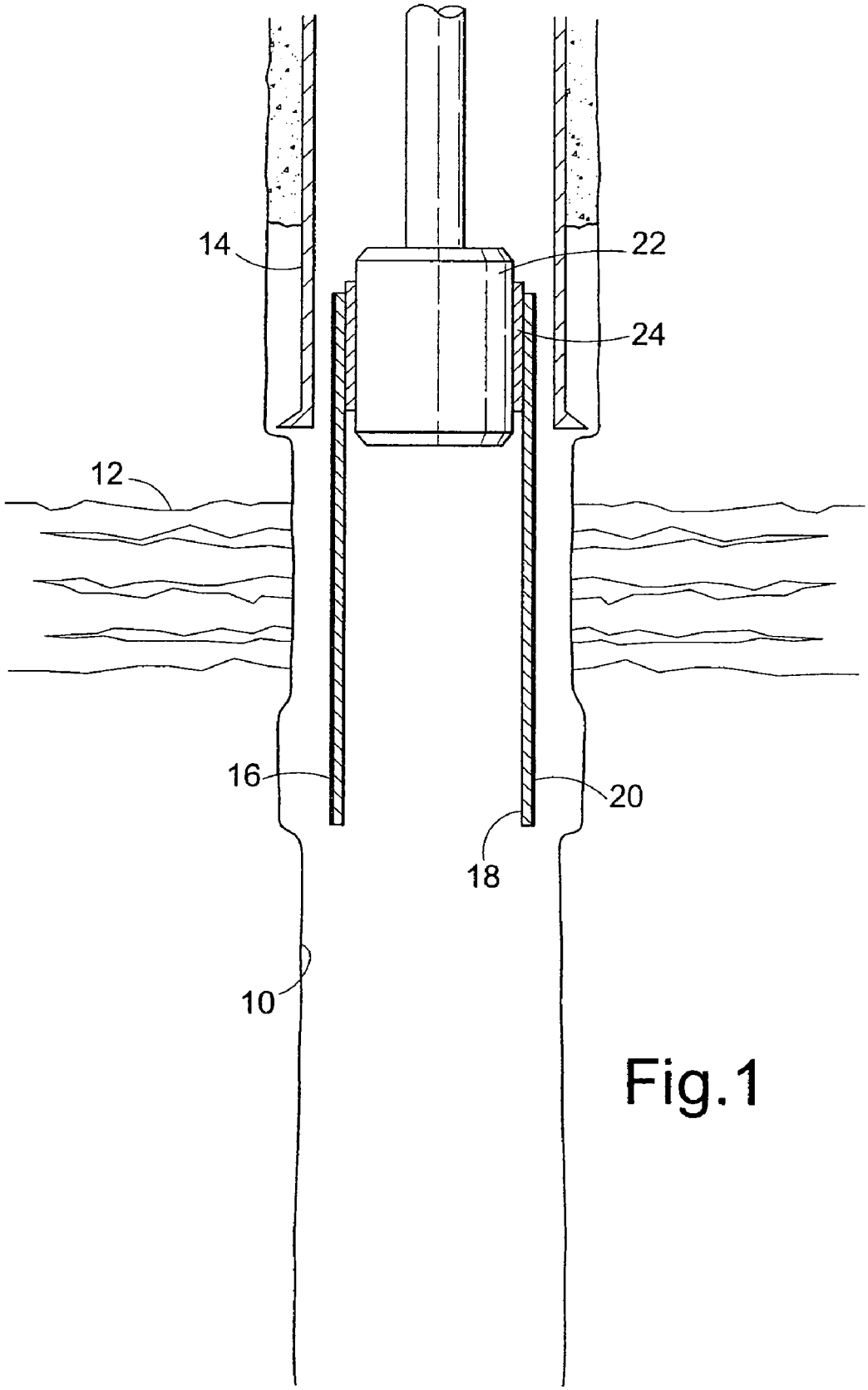
FIGS. 1 and 2 are schematic representations of steps in the process of isolating a problem zone, in accordance with a preferred embodiment of the present invention.
Figure 2:
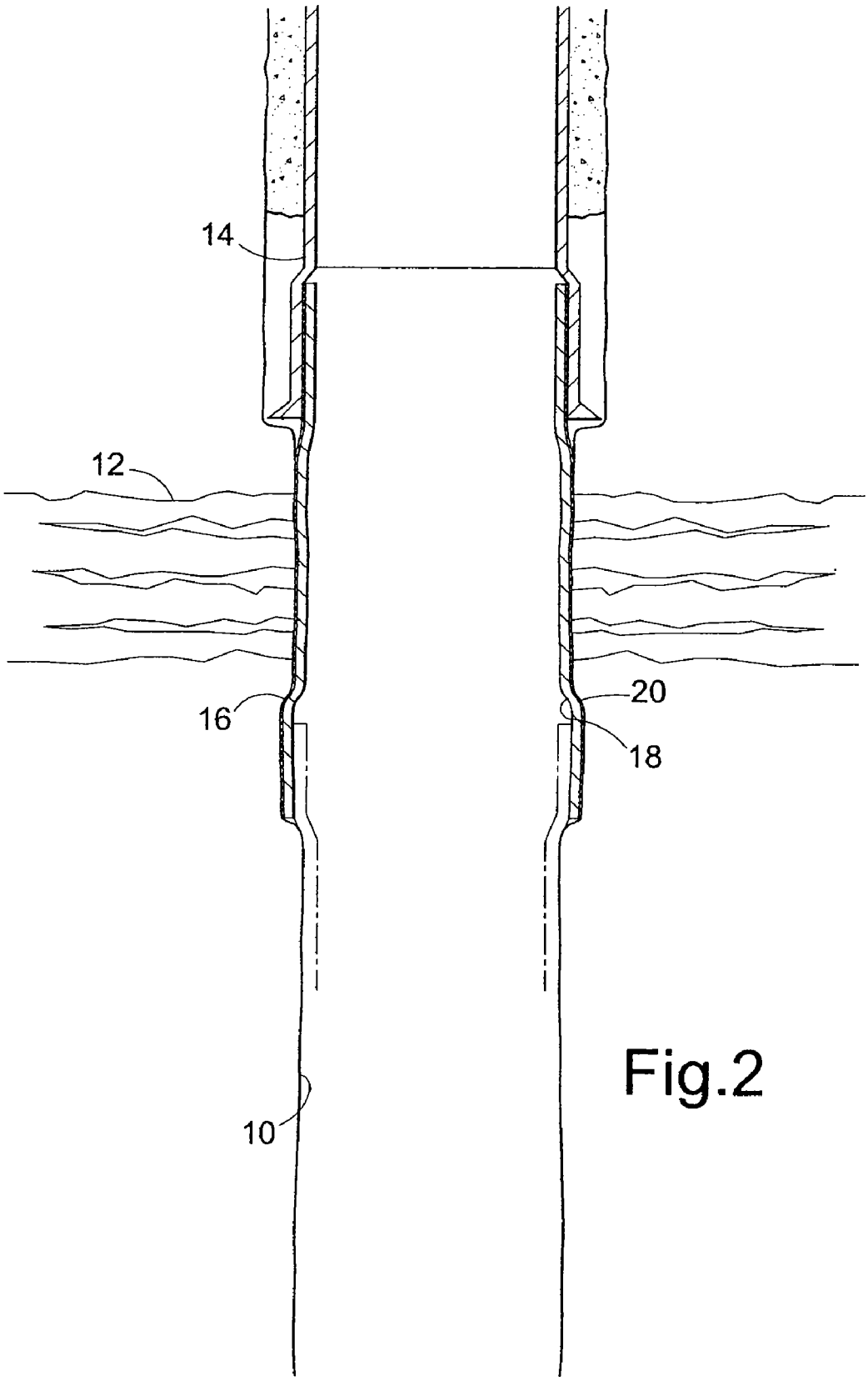

Reference is made to FIGS. 1 and 2 of the drawings, which illustrate, somewhat schematically, a method of isolating a problem formation in accordance with a preferred embodiment of the present invention. A bore 10 has been drilled through a formation or zone 12, which may take the form of a loss zone, over pressured zone, water producing zone, or a mechanically unstable zone. The zone is located beyond the lower end of a previously installed and cemented casing 14. Modern surveying techniques are such that the presence of the zone will likely have been predicted, such that the operator will be equipped and prepared to deal with the problem zone, as described below.

In this example the operator has been drilling the bore beyond the casing 14 to a diameter corresponding to the inner diameter of the casing. However, in the vicinity of the problem zone 12, the bore is drilled to a larger diameter, for example by means of a bi-centre bit, to a diameter closer to the outer diameter of the casing 14. Furthermore, for a section beyond the problem zone 12, the bore has been drilled to a still larger diameter. It should also be noted that the lower portion of the annulus between the casing 14 and the bore wall is substantially free of cement, as may be achieved using the apparatus and methods disclosed in applicant's PCT/GB01/04202 and U.S. patent application Ser. No. 09/956,717 filed on Sep. 20, 2001, now U.S. Pat. No. 6,725,917, the disclosures of which are incorporated herein by reference.

A section of tubing, in the form of a patch 16, is then run into the bore 10, and positioned across the problem zone 12, as shown in FIG. 1, the upper end of the patch 16 overlapping the lower end of the casing 14. The patch 16 features an inner structural steel layer 18, and an outer formable elastomer layer 20. The patch 16 is run into the bore on a running string provided with a compliant rotary expander 22, which features a number of radially movable piston-mounted rollers 24.

By supplying hydraulic fluid at elevated pressure to the interior of the expander 22, the rollers 24 are radially extended to contact the inner surface of the patch. The actuated expander 22 is then rotated within the patch 16, which causes the patch 16 to expand into contact with the inner face of the casing 14 and then expand the casing 14, such that the inner diameter of the patch 16 may be expanded to a similar diameter to the unexpanded casing 14. The expander then continues through the patch 16, expanding the remainder of the patch into intimate contact with the bore wall. The degree of expansion provided by the expander is selected to be sufficient to urge the outer face of the patch 16 into the inner wall of the casing, and then the bore wall, with some degree of force, such that the outer elastomer layer 20 forms a seal with the casing 14 and is deformed and is moulded to conform to the irregular bore wall. Furthermore, as a compliant expander 22 is being utilised, any substantial variations in bore wall profile may be accommodated by expanding the structural layer 20 to different extents.

The expander 22 continues its progress through the patch 16, such that the expanded patch follows the profile of the bore wall, forms a hydraulic seal with the bore wall, and isolates the problem zone.

The provision of the "oversize" bore in the vicinity of the problem zone allows expansion of the patch 16 to a diameter corresponding up to and beyond the diameter of the unexpanded casing 14, such that the presence of the patch 16 does not result in a loss of bore diameter. Furthermore, if a further patch is required (shown in chain-dotted outline), this may be run into the bore to overlap with the existing patch within the lower over-expanded portion of the patch 16, such that there is no loss of bore diameter experienced at the overlap.

It will thus be apparent to those of skill in the art that this embodiment of the present invention provides an effective and convenient means for isolating problem formations in a well, without requiring use of cement or other curable fluids.

It will further be apparent to those of skill in the art that the embodiment described above is merely exemplary of the present invention, and that various modifications and improvements may be made thereto without departing from the scope of the invention. For example, in another embodiment, the patch may be located in a section of open hole, spaced from any existing casing. In such a case, it is preferable that the bore is enlarged to accommodate the patch such that patched bore wall has a substantially constant diameter despite the presence of the expanded patch. In the example described, the tubing is solid-walled throughout its depth; in other embodiments, it may be possible to provide a tubing having at least a structural element of slotted or perforated tubing.

The invention claimed is:

1. A method of isolating a section of a drilled bore, the method comprising:

forming an unlined section of the drilled bore and enlarging a section of the unlined section;

disposing a tubing with an expander operatively coupled thereto into the drilled bore;

locating at least a portion of the tubing in the unlined section of the drilled bore to be isolated, wherein the portion of tubing comprises an outer relatively deformable layer; and expanding the portion of the tubing into circumferential contact with a wall of the unlined section by using the expander such that the expanded portion conforms to irregularities in the wall of the unlined section of the drilled bore, wherein the outer relatively deformable layer extends across the irregularities in the wall and a section of the portion of the tubing is located in the enlarged section of the unlined section, wherein the enlarged section has a larger diameter than the unlined section.

2. The method of claim 1, wherein the tubing comprises a structural layer surrounded by the outer relatively deformable layer for contact with the bore wall.

3. The method of claim 2, wherein the deformable layer engages substantially the entire section of the drilled bore to be isolated upon expansion of the tubing.

4. The method of claim 2, wherein the deformable layer is an elastomer.

5. The method of claim 2, wherein the deformable layer swells in situ upon contact with hydrocarbon fluids to ensure contact with the wall of the unlined section.

6. The method of claim 1, wherein expanding the tubing provides a hydraulic seal between the tubing and the bore.

7. The method of claim 1, further comprising locating the tubing within the unlined section of the bore, spaced from existing tubing.

8. The method of claim 1, wherein at least a portion of the tubing is adapted to conform to a section of lined bore wall.

9. The method of claim 1, wherein the tubing is adapted to conform to both a section of unlined bore wall and a section of lined bore wall.

10. The method of claim 1, wherein the section of tubing is expanded such that an inner diameter of the section of tubing is substantially equal to an inner diameter of the lined bore.

11. The method of claim 1, further comprising enlarging a portion of the expanded tubing at a lower end thereof.

12. The method of claim 1, further comprising locating the section of tubing such that an end of the expanded tubing overlaps an existing tubing.

13. A method of isolating a section of a bore, the method comprising:

drilling a section of bore below an existing section of bore-lining tubing to a larger diameter than an inner diameter of the existing tubing;

positioning a tubing adjacent an unlined section of the bore to be isolated, the tubing having an outer relatively deformable layer; and expanding the tubing into circumferential contact with at least a portion of the unlined section of the bore by using a compliant expansion device such that the tubing conforms to a non-uniform portion in the bore, wherein the outer relatively deformable layer is disposed across the non-uniform portion in the bore and the section of tubing placed below the existing tubing is expanded to a diameter similar to that of the existing tubing.

14. The method of claim 13, wherein the expansion device is alterable in configuration between a first diameter and a second diameter.

15. The method of claim 13, further comprising locating the section of tubing across a problem zone, and isolating the problem zone from the bore with the expanded tubing, wherein the relatively deformable layer is disposed across the problem zone.

16. The method of claim 15, wherein the problem zone is a fluid loss zone.

17. The method of claim 15, wherein the problem zone is a section of bore where a mechanical collapse has occurred or is considered likely to occur.

18. The method of claim 13, wherein the deformable layer is substantially along the entire length of the tubing section.

19. The method of claim 13, further comprising locating the tubing in a bore below an existing section of bore-lining tubing.

20. The method of claim 19, further comprising locating the section of tubing such that an upper end of the expanded tubing overlaps the existing tubing.

21. The method of claim 19, further comprising expanding the upper end of the section of tubing to form a seal with the existing tubing.

22. The method of claim 13, wherein the expansion device is operatively connected to a portion of the tubing during the location thereof.

23. The method of claim 13, wherein the deformable layer swells in situ upon contact with hydrocarbon fluids to ensure contact with the unlined section of the bore.

24. A method of isolating a section of a wellbore, the method comprising:

lowering a tubing into the wellbore, wherein the wellbore includes a lined section and an unlined section;

positioning at least a portion of the tubing adjacent the unlined section to be isolated, wherein the portion of tubing comprises an outer relatively deformable layer; and expanding the tubing into circumferential contact with the unlined section of the bore by using a compliant expansion device such that the tubing conforms to irregularities in the wellbore and an inner diameter of the tubing is substantially equal to an inner diameter of the lined portion, wherein the outer relatively deformable layer extends across the irregularities in the wellbore.

25. A method of isolating a section of a bore, the method comprising:

positioning a tubing adjacent an unlined section of the bore to be isolated, the tubing having an outer relatively deformable layer; and deforming the tubing in a manner whereby the tubing assumes a shape of a non-circular surrounding surface and forms a circumferential seal therebetween, wherein the tubing is deformed by first using a fixed diameter device and then by using a compliant expansion device coupled to the fixed diameter device, wherein the outer relatively deformable layer extends across the non-circular surrounding surface.

26. The method of claim 25, wherein the deformable layer swells in situ upon contact with hydrocarbon fluids to ensure a seal with the bore.

27. A method of isolating a problem zone of a wellbore, the method comprising:

disposing a tubing with an expander operatively coupled thereto into the wellbore;

locating at least a first portion of the tubing adjacent a casing located in the wellbore;

locating at least a second portion of the tubing adjacent the problem zone of the wellbore to be isolated, wherein the first and second portions comprise an outer relatively deformable layer;

expanding the first portion of the tubing into circumferential contact with the casing and further expanding the first portion and the casing such that the first portion of the tubing is expanded to an inner diameter similar to an inner diameter of an unexpanded portion of the casing; and expanding the second portion of the tubing into circumferential contact with the problem zone such that the expanded second portion conforms to irregularities of the problem zone.

28. The method of claim 27, wherein the outer relatively deformable layer extends across the irregularities of the problem.

* * * * *